US012474091B2

(12) United States Patent
Chauhan et al.

(10) Patent No.: US 12,474,091 B2
(45) Date of Patent: Nov. 18, 2025

(54) VACUUM INSULATED STRUCTURE WITH A SERIES EVAPORATOR

(71) Applicant: WHIRLPOOL CORPORATION, Benton Harbor, MI (US)

(72) Inventors: Vishal Brahmanand Chauhan, Maharashtra (IN); Rahul Subhash Chhajed, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 143 days.

(21) Appl. No.: 18/226,322

(22) Filed: Jul. 26, 2023

(65) Prior Publication Data

US 2025/0035344 A1 Jan. 30, 2025

(51) Int. Cl.

| | |
|---|---|
| ***F25D 23/06*** | (2006.01) |
| ***F25B 5/04*** | (2006.01) |
| ***F25B 41/20*** | (2021.01) |
| ***F25B 41/40*** | (2021.01) |
| ***F25D 11/02*** | (2006.01) |

(52) U.S. Cl.

CPC ..... *F25B 5/04* (2013.01); *F25B 41/20* (2021.01); *F25B 41/40* (2021.01); *F25D 11/022* (2013.01); *F25D 23/061* (2013.01); *F25D 23/062* (2013.01); *F25D 23/068* (2013.01); *F25D 2201/14* (2013.01)

(58) Field of Classification Search

CPC ..... F25D 5/04; F25D 11/022; F25D 23/06; F25D 23/061; F25D 23/062; F25D 23/065; F25D 23/068

See application file for complete search history.

(56) References Cited

U.S. PATENT DOCUMENTS

| | | | | |
|---|---|---|---|---|
| 6,185,948 | B1 * | 2/2001 | Niki | F25B 5/04 62/199 |
| 6,253,561 | B1 | 7/2001 | Imakubo | |
| 6,370,895 | B1 | 4/2002 | Sakuma et al. | |
| 6,427,463 | B1 | 8/2002 | James | |

(Continued)

FOREIGN PATENT DOCUMENTS

| | | | |
|---|---|---|---|
| EP | 0789206 | B1 | 10/2003 |
| EP | 3839387 | A1 | 6/2021 |

(Continued)

*Primary Examiner* — Jonathan Bradford
(74) *Attorney, Agent, or Firm* — Price Heneveld LLP

(57) ABSTRACT

A refrigeration unit includes a cabinet with a refrigerator compartment, a freezer compartment, and a machine compartment. The cabinet includes a mullion region between the refrigerator compartment and the freezer compartment, a first pass-through therethrough providing access from an external environment to the refrigerator compartment, and a second pass-through therethrough providing access from the external environment to the freezer compartment. The cabinet further includes a third pass-through extending through the mullion region, and a refrigerant system. The refrigerant system includes a three-way valve configured to direct a refrigerant down a first flow path or a second flow path, the refrigerant in the first flow path flows through the first pass-through, a first evaporator, the third pass-through, and the second evaporator, and the refrigerant in the second flow path flows through the second pass-through and the second evaporator.

20 Claims, 9 Drawing Sheets

(56) References Cited

U.S. PATENT DOCUMENTS

| | | | | |
|---|---|---|---|---|
| 7,506,520 | B2 | 3/2009 | Oh | |
| 7,765,815 | B2 | 8/2010 | Yoon et al. | |
| 10,544,979 | B2 | 1/2020 | Clark et al. | |
| 11,175,089 | B2 | 11/2021 | Marinello et al. | |
| 2007/0151289 | A1 | 7/2007 | Youn et al. | |
| 2019/0032989 | A1* | 1/2019 | Kim | F25D 17/067 |
| 2021/0190413 | A1* | 6/2021 | Marinello | F25D 23/061 |

FOREIGN PATENT DOCUMENTS

| | | | |
|---|---|---|---|
| WO | 2005052475 | A1 | 6/2005 |
| WO | 2020207899 | A1 | 10/2020 |

* cited by examiner

VACUUM INSULATED STRUCTURE WITH A SERIES EVAPORATOR

BACKGROUND OF THE DISCLOSURE

The present disclosure generally relates to a vacuum insulated structure, and more specifically, to a vacuum insulated structure with a series evaporator system.

SUMMARY OF THE DISCLOSURE

According to one aspect of the present disclosure, a refrigeration unit is provided that includes a cabinet that defines a refrigerator compartment, a freezer compartment, and a machine compartment. The cabinet includes a mullion region between the refrigerator compartment and the freezer compartment, a first pass-through therethrough providing access from an external environment to the refrigerator compartment, and a second pass-through therethrough providing access from the external environment to the freezer compartment. The cabinet further includes a third pass-through extending through the mullion region, and a refrigerant system. The refrigerant system includes a three-way valve configured to direct a refrigerant down a first flow path or a second flow path. The refrigerant in the first flow path flows through the first pass-through, a first evaporator, the third pass-through, and the second evaporator, and the refrigerant in the second flow path flows through the second pass-through and the second evaporator.

According to another aspect of the present disclosure, a refrigeration unit is provided that includes a cabinet defining a refrigerator compartment, a freezer compartment, and a machine compartment. The cabinet also includes a wrapper, a liner encompassed by the wrapper, a mullion region between the refrigerator compartment and the freezer compartment, a first pass-through therethrough providing access from an external environment to the refrigerator compartment, a second pass-through therethrough providing access from the external environment to the freezer compartment, a third pass-through extending through the mullion region, and a refrigerant system. The refrigerant system includes a first refrigerant flow path, where a refrigerant is directed through the first pass-through, a first evaporator, the third pass-through, and a second evaporator in the first refrigerant flow path. The refrigerant system also includes a second refrigerant flow path, where the refrigerant is directed through the second pass-through and the second evaporator in the second refrigerant flow path.

According to yet another aspect of the present disclosure, a vacuum insulated refrigeration appliance is provided. The vacuum insulated refrigeration appliance includes a cabinet that defines a refrigerator compartment, a freezer compartment, and a mullion region between the refrigerator compartment and the freezer compartment. A first pass-through is defined through the mullion region, and a second pass-through extends through the cabinet and provides access from an external environment to the refrigerator compartment. The appliance also includes a first service line extending through the second pass-through and into the refrigerator compartment. The second service line includes at least one branch extending through the first pass-through and into the freezer compartment. The refrigerant system includes a first evaporator, a second evaporator, and a three-way valve that selectively directs a refrigerant along at least one of a first flow path through the first evaporator, the pass-through, and the second evaporator, and a second flow path through the second evaporator. The first evaporator and the second evaporator are arranged in series along the first flow path. The refrigerant at least partially flows along the at least one branch along the first flow path.

These and other features, advantages, and objects of the present disclosure will be further understood and appreciated by those skilled in the art by reference to the following specification, claims, and appended drawings.

Figure 1:
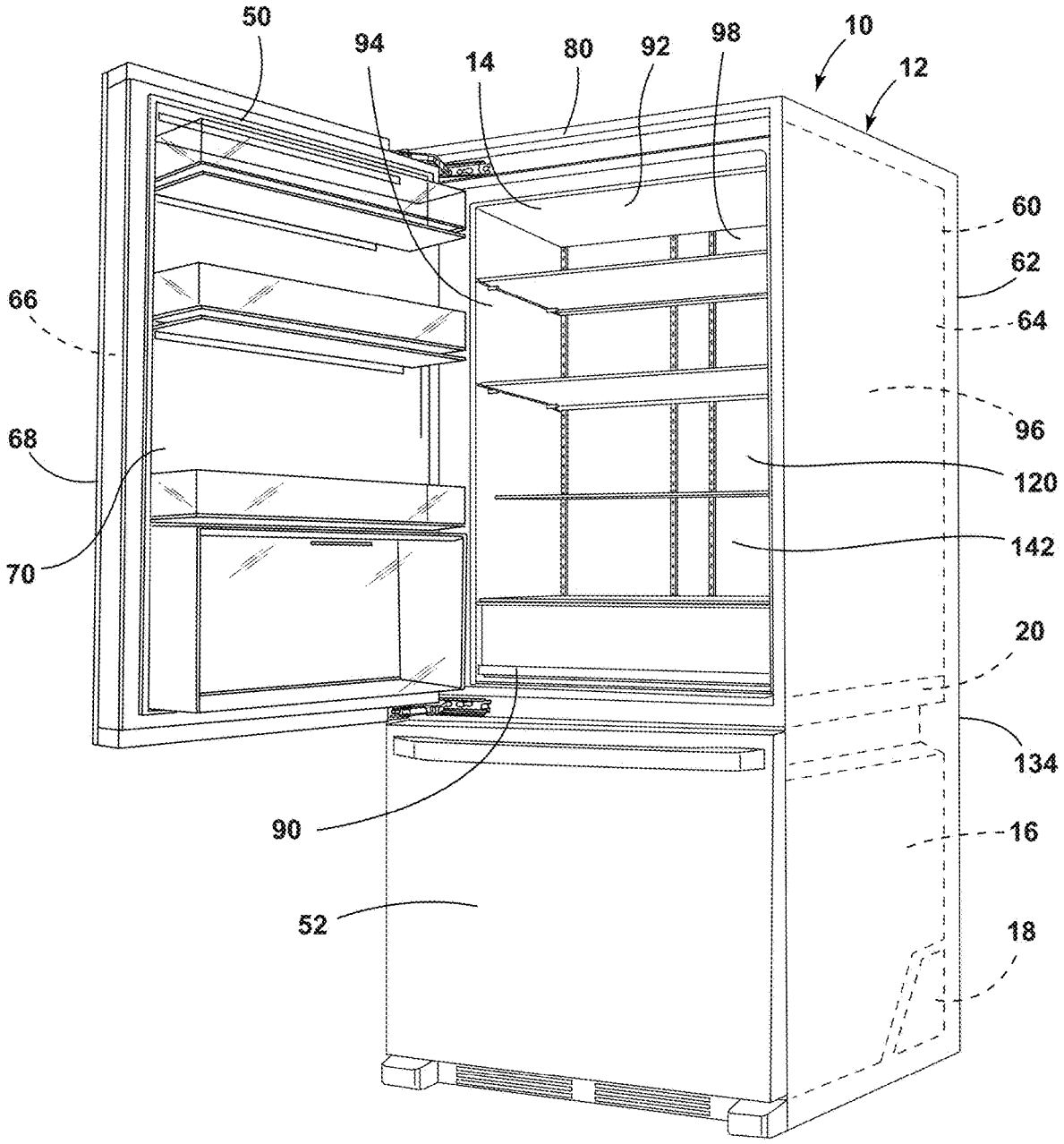
FIG. 1 is a front perspective view of a vacuum insulated appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a vacuum insulated appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-9, reference numeral 10 generally designates a refrigeration appliance 10. The refrigeration appliance 10 includes a cabinet 12 that defines a refrigerator compartment 14, a freezer compartment 16, and a machine compartment 18. A mullion region 20 is defined by the cabinet 12 between the refrigerator compartment 14 and the freezer compartment 16. A first pass-through 22 is defined by and extends through the cabinet 12 to provide access from an external environment 24 to the refrigerator compartment 14. A second pass-through 26 is defined by and extends through the cabinet 12 to provide access from the external environment 24 to the freezer compartment 16. A third pass-through 28 is defined by the cabinet 12 and extends through the mullion region 20. The refrigeration appliance 10 also includes a refrigerant system 30. The refrigerant system 30 includes a three-way valve 32 that is configured to selectively direct refrigerant along a first flow path 34 and a second flow path 36. The refrigerant in the first flow path 34 flows through the first pass-through 22, a first evaporator 38, the third pass-through 28, and a second evaporator 40. The refrigerant in the second flow path 36 flows through the second pass-through 26 and through the second evaporator 40.

Figure 2:
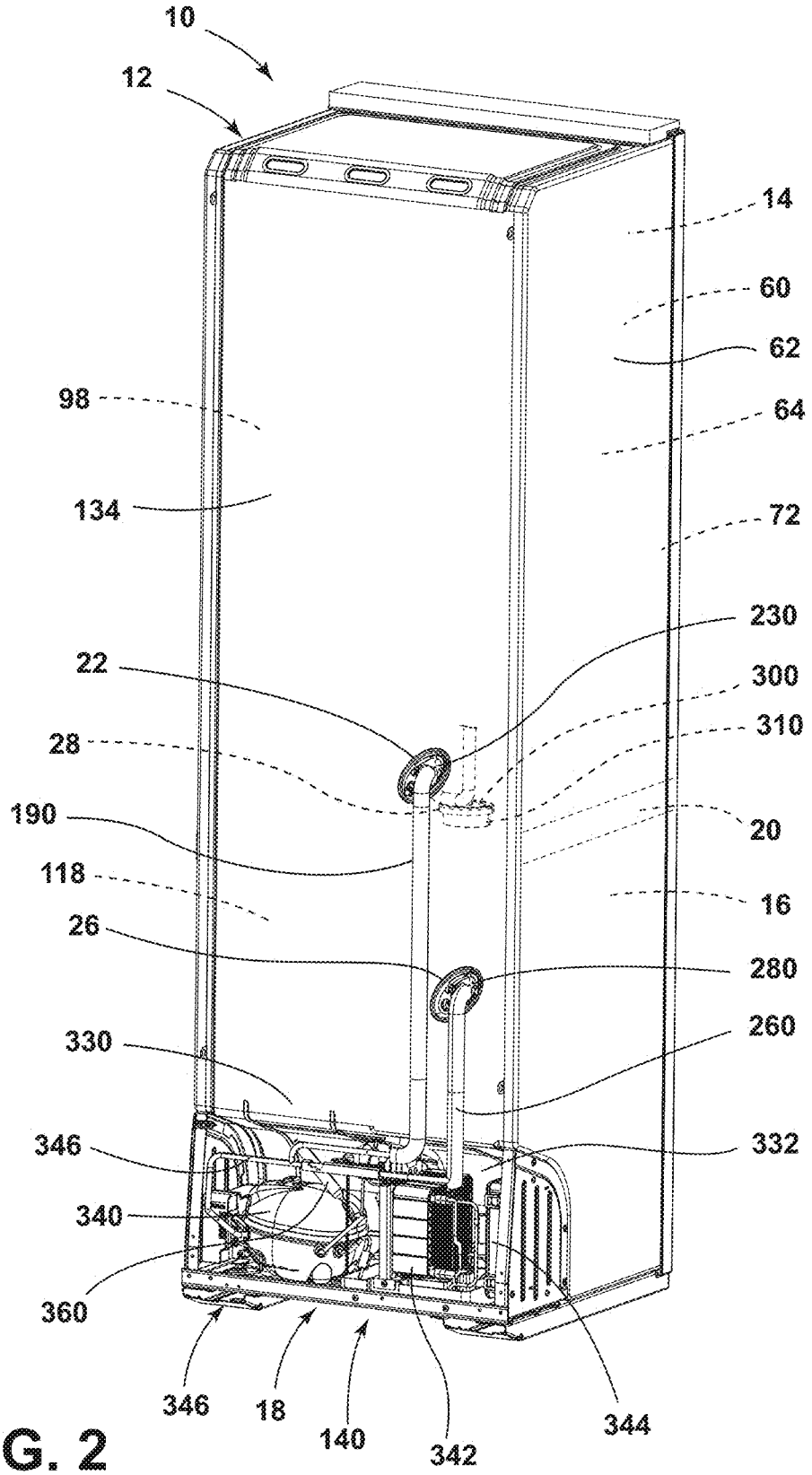
FIG. 2 is a rear perspective view of a vacuum insulated appliance, according to the present disclosure.
Figure 3:
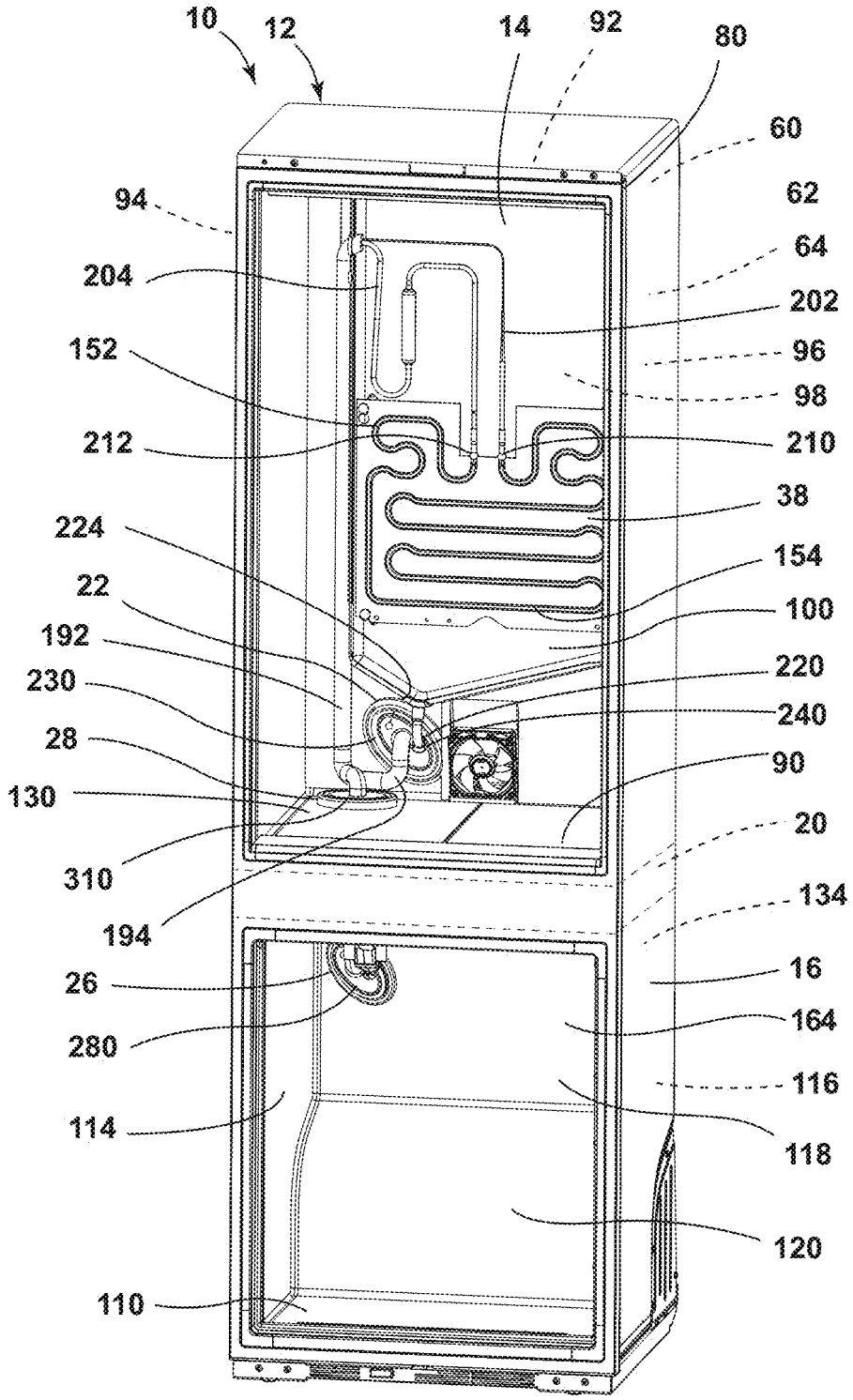
FIG. 3 is a front perspective view of a portion of a vacuum insulated appliance with a first pass-through to a first compartment, a second pass-through to a second compartment, and a third pass-through between the first and second compartments, according to the present disclosure.

Referring to FIGS. 1-3, the appliance 10 is illustrated as a vacuum insulated refrigeration appliance, however, it is contemplated that the appliance 10 disclosed herein may be a variety of appliances, structures, or for insulation purposes other than with an appliance 10. The refrigeration appliance 10 is illustrated as a bottom-mount refrigerator having an insulated door 50 and a pull-out drawer 52, which can both have substantially similar configurations, as discussed further herein. The cabinet 12 of the illustrated appliance 10 includes an upper compartment configured as the refrigerator compartment 14 and a lower compartment configured as the freezer compartment 16. In this way, the refrigerator and freezer compartments 14, 16 defined by the cabinet 12 can be sealed with the insulated door 50 and the pull-out drawer 52, respectively. The appliance 10 may be, for example, a bottom-mount French door refrigerator, a top-mount refrigerator, a side-by-side refrigerator, a 4-door French door refrigerator, and/or a 5-door French door refrigerator. Further, the present disclosure is not limited to refrigerators. The appliance 10 may be, for example, a freezer, a cooler, a vacuum insulated structure, and/or other similar appliances and fixtures within household and commercial settings.

The cabinet 12 of the appliance 10 is an insulated structure having a vacuum insulated cavity 60 defined between a wrapper 62 and a liner 64. Similarly, the insulated door 50, and the pull-out drawer 52 are insulated structures having a door vacuum insulated cavity 66 defined between a door wrapper 68 coupled to a door liner 70. Each of the vacuum insulated cavities 60, 66 of the cabinet 12 and the insulated doors 50, 52 typically includes one or more insulation materials disposed therein. It is generally contemplated that the insulation materials may be glass-type materials, carbon-based powders, silicon oxide-based materials, silica-based materials, insulating gases, and other standard insulation materials known in the art. The insulation materials substantially fill the vacuum insulated cavity 60, forming a substantially continuous layer between the wrapper 62 and the liner 64. Similarly, the insulation materials substantially fill the door vacuum insulated cavity 66, forming a substantially continuous layer between the door wrapper 68 and the door liner 70. The insulated cavities 60, 66 are filled with the insulation materials using a load port on the cabinet 12 and the insulated doors 50, 52 respectively. The cabinet 12 and the insulated doors 50, 52 each defined an evacuation port for applying a vacuum or negative pressure to the insulated cavities 60, 66.

An at least partial vacuum 72 is defined within the vacuum insulated cavities 60, 66. The at least partial vacuum 72 defines a pressure differential between an exterior of the appliance 10 and the vacuum insulated cavities 60, 66. The pressure differential serves to define an inward compressive force that is exerted on both the wrapper 62 and the liner 64 and tends to bias the wrapper 62 and the liner 64 towards the vacuum insulated cavity 60. The pressure differential and the inward compressive force are also exerted on both the door wrapper 68 and the door liner 70 of the insulated doors 50, 52 and tend to bias the door wrapper 68 and the door liner 70 towards the vacuum insulated cavity 66 in a similar manner.

The wrapper 62, the liner 64, the door wrapper 68, and the door liner 70 are made from a material at least partially resistant to bending, deformation, or otherwise being formed in response to an inward compressive force. These materials for the wrapper 62, the door wrapper 68, the liner 64, and the door liner 70 include, but are not limited to, metals, polymers, metal alloys, combinations thereof, and/or other similar substantially rigid materials that can be used for vacuum insulated appliances and structures.

Referring still to FIG. 1, the vacuum insulated structure 10 includes the wrapper 62, the liner 64 coupled to the wrapper 62, and a trim breaker 80 coupled to the wrapper 62 and the liner 64. The wrapper 62 generally faces the liner 64 and at least partially encompasses the liner 64. The vacuum insulated cavity 60 is defined in the space between the wrapper 62 and the liner 64, and the trim breaker 80 seals the vacuum insulated cavity 60. According to various aspects, the reduced pressure within the vacuum insulated cavity 60 relative to the external environment 24 is such that a rate of heat transfer between the external environment 24 and the refrigerator compartment 14 and/or the freezer compartment 16 is reduced.

Referring still to FIG. 1, as well as FIGS. 2-6, the cabinet 12 defines the refrigerator compartment 14 and the freezer compartment 16. In use, the refrigerator compartment 14 and the freezer compartment 16 are maintained at different temperatures. For example, the refrigerator compartment 14 can be configured to maintain a temperature above about 0° C. but below the ambient temperature of the external environment 24, such as within a range from greater than about 0° C. to about 8° C. The refrigerator compartment 14 is used to maintain a food item disposed therein at a cold but not freezing temperature to prolong the usable life of the food item. The freezer compartment 16 can be configured to maintain a temperature that is less than or equal to about 0° C. The freezer compartment 16 is used to maintain the food item disposed therein in a frozen state to prolong the usable life of the food item. The refrigerator compartment 14 can be disposed above the freezer compartment 16, as in the illustrated example of FIG. 3, although other configurations are generally contemplated.

Figure 4:
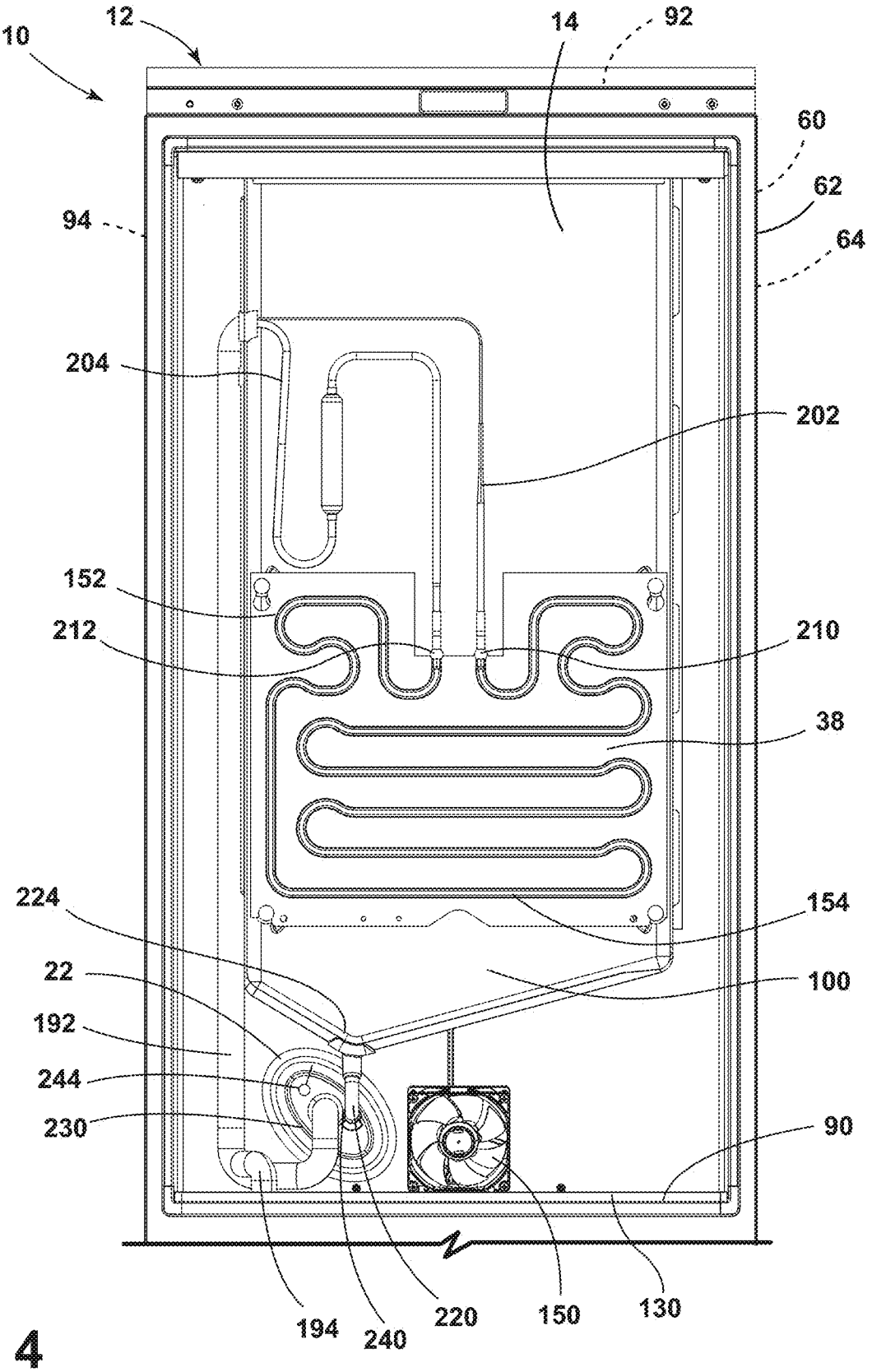
FIG. 4 is a front elevational view of a refrigerator compartment with a first evaporator and a first pass-through, according to the present disclosure.

Referring further to FIGS. 1, 3, and 4, the refrigerator compartment 14 is defined by a floor 90, a ceiling 92 opposing the floor 90, a first sidewall 94, a second sidewall 96 opposing the first sidewall 94, and a rear wall 98. The refrigerator compartment 14 also defines an opening 100 that opposes the rear wall 98 and operably provides access to the refrigerator compartment 14. As illustrated in FIG. 1, the opening 100 is operably sealed from the external environment 24 via the insulated door 50, which is pivotable between an opened position and a closed position. According to various aspects, the liner 64 of the vacuum insulated structure 10 provides the floor 90, the ceiling 92, the first sidewall 94, the second sidewall 96, and the rear wall 98 of the refrigerator compartment 14.

Figure 6:
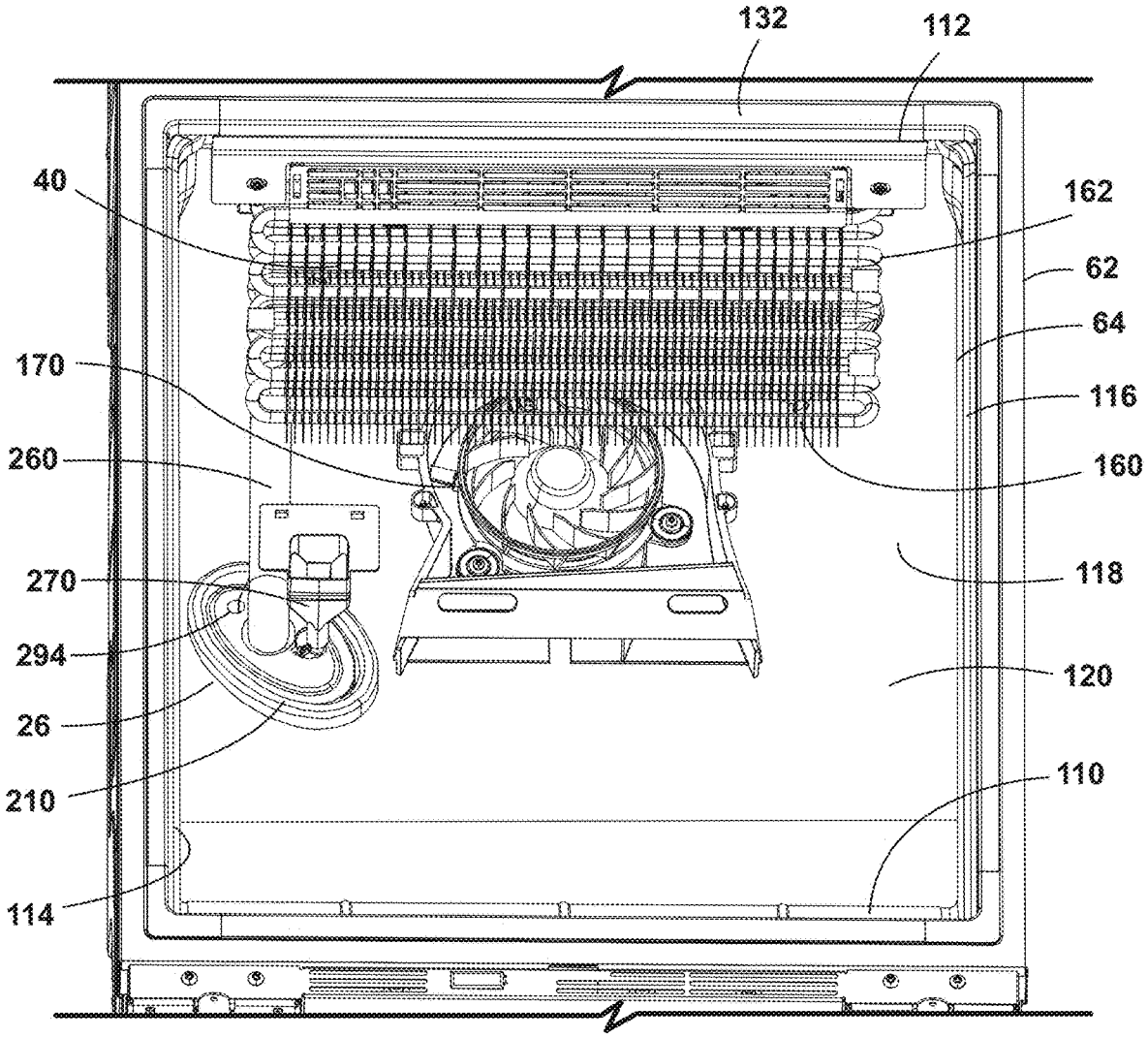
FIG. 6 is a front perspective view of a freezer compartment with a second evaporator and a second pass-through, according to the present disclosure.

Referring to FIGS. 3 and 6, the freezer compartment 16 likewise is defined by a floor 110, a ceiling 112 opposing the floor 110, a first sidewall 114, a second sidewall 116 opposing the first sidewall 114, and a rear wall 118. The freezer compartment 16 also defines an opening 120 that opposes the rear wall 118 and operably provides access to the freezer compartment 16. As illustrated in FIG. 1, the opening 120 to the freezer compartment 16 is operably sealed from the external environment 24 via the pull-out drawer 52, which is movable between an opened position and a closed position. According to various aspects, the liner 64 of the vacuum insulated structure 10 provides the floor 110, the ceiling 112, the first sidewall 114, the second sidewall 116, and the rear wall 118 of the freezer compartment 16.

Referring to FIG. 3, the mullion region 20 is defined between the refrigerator compartment 14 and the freezer compartment 16. In such examples, the floor 90 of the refrigerator compartment 14 may define a top section 130 of the mullion region 20 and the ceiling 112 of the freezer compartment 16 may define a bottom section 132 of the mullion region 20. In various aspects, the liner 64 may be defined such that the vacuum insulated cavity 60 extends from a rear portion 134 of the cabinet 12, between the refrigerator compartment 14 and the freezer compartment 16, and toward the openings 100, 120 of the refrigerator compartment 14 and the freezer compartment 16.

Referring to FIGS. 3 and 4, the refrigeration appliance 10 includes the refrigerant system 30 that has the first evaporator 38. The first evaporator 38 is disposed within the refrigerator compartment 14. The first evaporator 38 is disposed adjacent the liner 64 of the vacuum insulated structure 10. In various examples, the first evaporator 38 is disposed on the rear wall 98 of the refrigerator compartment 14. In the illustrated example shown in FIG. 3, the first evaporator 38 is a roll bond evaporator that is coupled to the rear wall 98 of the refrigerator compartment 14. Additionally, in some examples, the first evaporator 38 may be disposed behind a cover panel 142 such that the first evaporator 38 is hidden when viewing the refrigerator compartment 14 through the opening 100. The first evaporator 38 withdraws heat from the refrigerator compartment 14 in order to maintain the temperature of the refrigerator compartment 14 below ambient temperature. For example, the first evaporator 38 may withdraw heat from the refrigerator compartment 14 to maintain the temperature within the refrigerator compartment 14 at a desired temperature, such as a temperature that is from about 0° C. to about 8° C.

Figure 5:
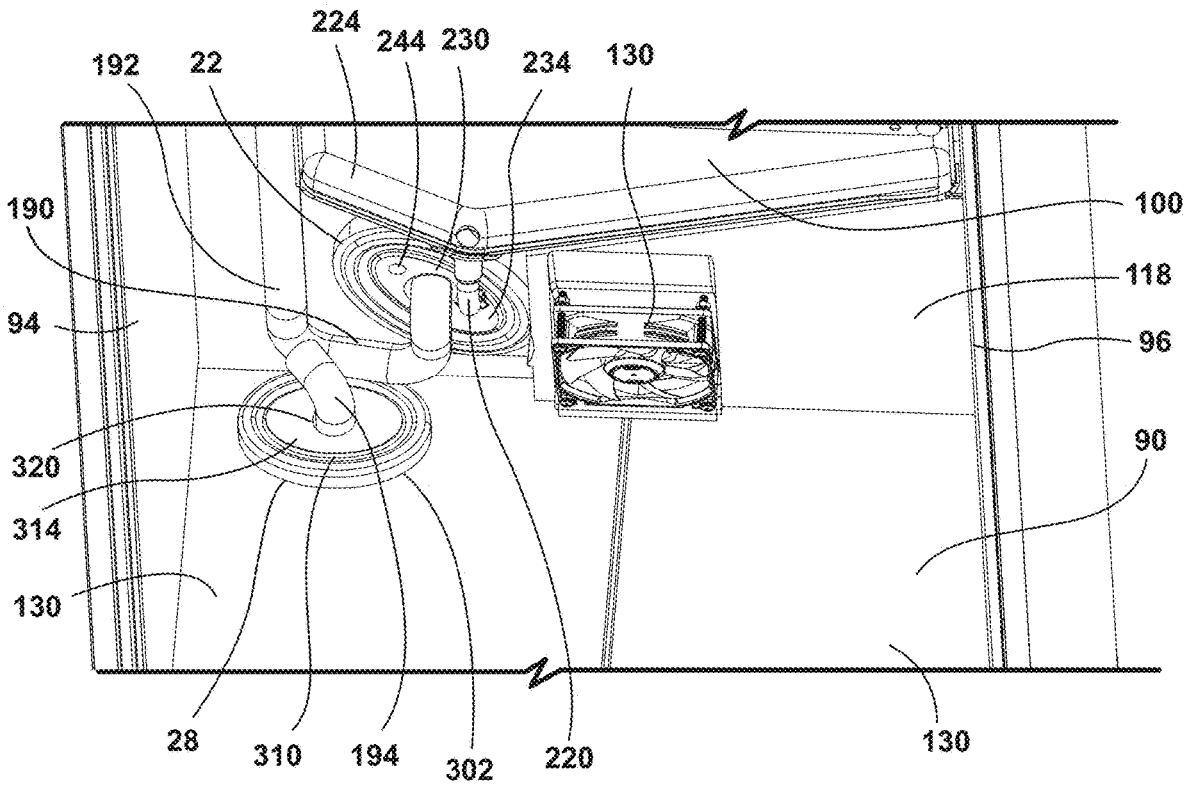
FIG. 5 is a partial top perspective view of a refrigerator compartment with a first pass-through, a second pass-through, and a first evaporator fan, according to the present disclosure.

Referring to FIGS. 3-5, the refrigerant system 30 includes a first evaporator fan 150 proximate the first evaporator 38. In various aspects, the first evaporator fan 150 may be a triple-bladed fan that is positioned proximate the first evaporator 38. The first evaporator fan 150 is positioned relative to the first evaporator 38 such that the first evaporator fan 150 pushes and/or pulls an airflow across the first evaporator 38 to assist in heat transfer between the first evaporator 38 and the airflow within the refrigerator compartment 14. For example, the first evaporator fan 150 may be positioned on the floor 90 near the rear wall 98 and facing towards the opening 100 of the refrigerator compartment 14 such that an airflow is pulled down the rear wall 98, across a top section 152 of the first evaporator 38 and then a bottom section 154 of the first evaporator 38, and out of the first evaporator fan 150. As the airflow flows across the first evaporator 38, the thermal transfer occurs such that the airflow within the refrigerator compartment 14 is cooled.

Figure 9:
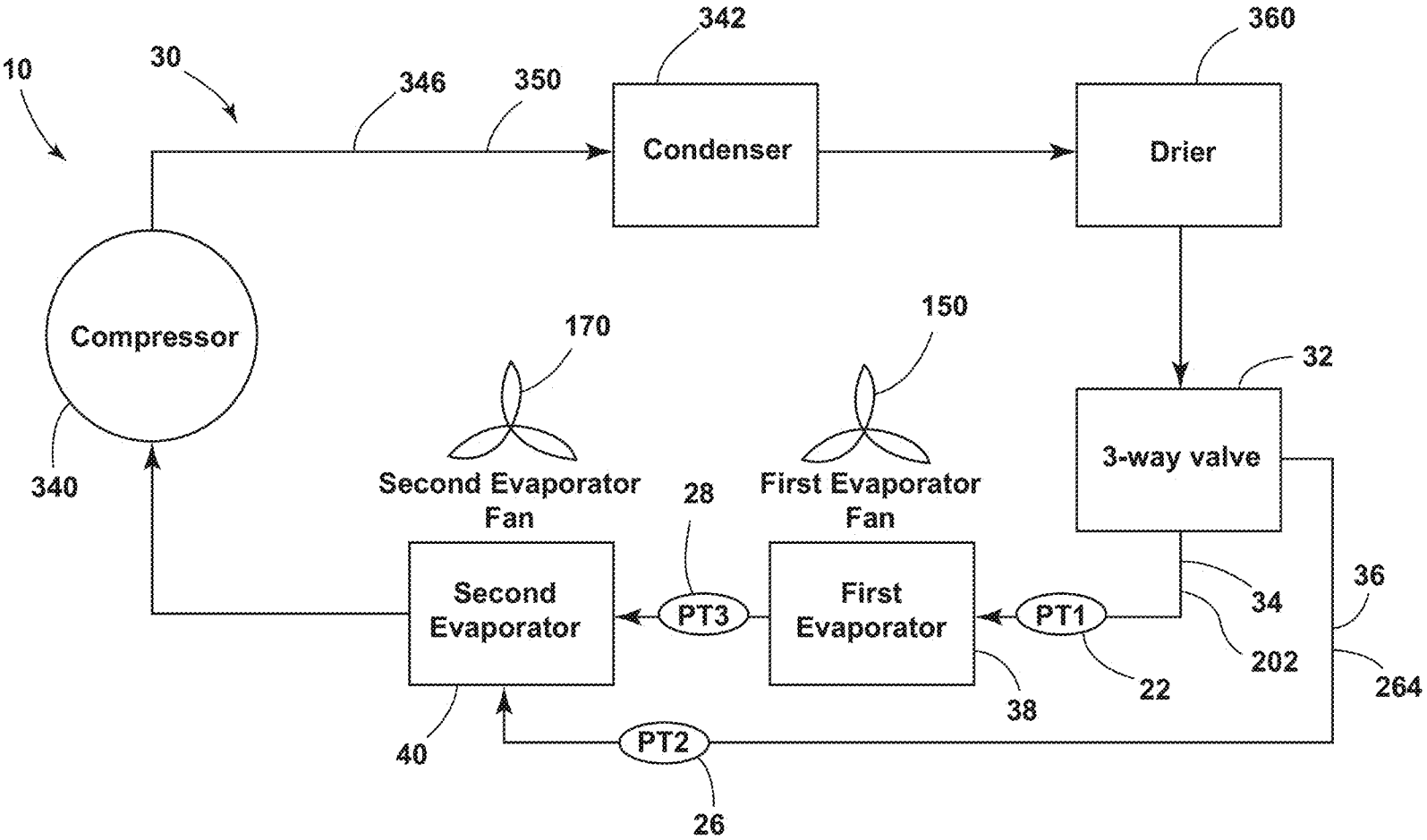
FIG. 9 is a flow diagram of a refrigerant system for a refrigeration appliance, according to the present disclosure.

Referring to FIGS. 6 and 9, the refrigerant system 30 includes the second evaporator 40. The second evaporator 40 is disposed within the freezer compartment 16. The second evaporator 40 is disposed adjacent the liner 64 of the vacuum insulated structure 10. In various examples, the second evaporator 40 is disposed proximate the rear wall 118 and the ceiling 112 of the freezer compartment 16 such that a rear portion 160 of the second evaporator 40 is proximate the rear wall 118 of the freezer compartment 16 and a top section 162 of the second evaporator 40 abuts and/or is proximate the ceiling 112 of the freezer compartment 16. For example, the second evaporator 40 may be a plate-and-tube evaporator that is coupled to the ceiling 112 and/or rear wall 118 of the freezer compartment 16.

In various examples, the second evaporator 40 may be disposed behind a cover panel 164 such that the second evaporator 40 is hidden when viewing the freezer compartment 16 through the opening 120. The second evaporator 40 withdraws heat from the freezer compartment 16 in order to maintain the temperature of the freezer compartment 16 below ambient temperature. For example, the second evaporator 40 may withdraw heat from the freezer compartment 16 to maintain the temperature within the freezer compartment 16 at a desired temperature, such as a temperature that is below about 0° C.

Referring still to FIGS. 6 and 9, the refrigerant system 30 includes a second evaporator fan 170 proximate the second evaporator 40. In various aspects, the second evaporator fan 170 may be a triple-bladed fan that is disposed proximate the second evaporator 40. The second evaporator fan 170 is positioned relative to the second evaporator 40 such that the second evaporator fan 170 pushes and/or pulls an airflow across the second evaporator 40. For example, the second evaporator fan 170 may be positioned on the ceiling 112 proximate the rear panel 118 and facing towards the opening 120 of the freezer compartment 16 such that an airflow is pulled up along the rear panel 118, across the second evaporator 40, and out of the second evaporator fan 170. As the airflow flows across the second evaporator 40, the thermal transfer occurs such that the airflow within the freezer compartment 16 is cooled.

Referring again to FIGS. 2-5 and 7, the vacuum insulated structure 10 includes the first pass-through 22 that extends from the external environment 24 to the refrigerator compartment 14. The first pass-through 22 is defined by a first wrapper aperture 180, which may be defined on a rear panel 182 of the wrapper 62, and a first liner aperture 184 defined by the rear wall 118 of the liner 64 and generally aligns with the first wrapper aperture 180. According to various aspects, the first wrapper aperture 180 and the first liner aperture 184 may be defined such that the first pass-through 22 defines a circular shape, an oblong shape, or one of various other shapes.

The first wrapper aperture 180 and the first liner aperture 184 are positioned on the wrapper 62 and the liner 64, respectively, such that passage is permitted between the external environment 24 and the refrigerator compartment 14. The alignment of the first wrapper aperture 180 and the first liner aperture 184 is such that various components are permitted to extend through the first pass-through 22 from the external environment 24 and into the refrigerator compartment 14, as provided herein.

The refrigeration appliance 10 includes a first service line 190. The first service line 190 extends from the external environment 24, through the first pass-through 22, and into the refrigerator compartment 14. In some examples, the first service line 190 extends into the refrigerator compartment 14 and diverges. In such examples, a first branch 192 of the first service line 190 extends along the rear wall 98 of the refrigerator compartment 14 and towards the ceiling 92 of the refrigerator compartment 14, and a second branch 194 of the first service line 190 extends towards the freezer compartment 16, as provided herein.

The first service line 190 may include an insulative sleeve 200 and one or more connectors and/or connection lines disposed within the insulative sleeve 200 for fluid and/or electrical connections within the appliance 10. In the illustrated examples of FIGS. 4 and 7, the first service line 190 includes a first capillary tube 202 and a first suction line 204 extending within the insulative sleeve 200. In such examples, the first capillary tube 202 and the first suction line 204 both extend along the first service line 190, through the first branch 192, and towards the first evaporator 38, as provided herein. According to various aspects, the first capillary tube 202 and the first suction line 204 may be positioned within the first service line 190 such that the first capillary tube 202 and the first suction line 204 are either proximate or distal from each other. For example, the first capillary tube 202 and the first suction line 204 may be abutting as both the first capillary tube 202 and the first suction line 204 extend along the first branch 192. In such examples, the close proximity may permit the transfer of thermal energy between the first capillary tube 202 and the first suction line 204. Additionally, it is generally contemplated that one or more additional lines may extend through the first pass-through 22 and into the refrigerator compartment 14. For example, an additional suction line heat exchanger line may extend through the first pass-through 22 and into the refrigerator compartment 14.

According to various aspects, the first capillary tube 202 and the first suction line 204 are in fluid communication with the first evaporator 38. The first capillary tube 202 extends from the three-way valve 32 to an inlet 210 of the first evaporator 38. In use, the first capillary tube 202 carries or guides the refrigerant to the first evaporator 38. The first suction line 204 extends from an outlet 212 of the first evaporator 38, along the first branch 192, then the second branch 194, and then to the second evaporator 40. In use, the first suction line 204 carries refrigerant away from the first evaporator 38 and towards the second evaporator 40. For example, in the illustrated example of FIG. 3, where the first evaporator 38 is a roll bond evaporator, the first capillary tube 202 extends from the three-way valve 32, through the first service line 190 and along the first branch 192, and to the inlet 210 at a top portion of the first evaporator 38, and the suction line 204 is coupled to the outlet 212 of the first evaporator 38 and extends away from the first evaporator 38 along the first branch 192 and the second branch 192, and then towards the second evaporator 40.

The refrigeration appliance 10 includes a first drain tube 220. The first drain tube 220 extends from the external environment 24, through the first pass-through 22, and into the refrigerator compartment 14. In some examples, the first drain tube 220 extends from a drain pan in the external environment 24, such as in the machine compartment 18, through the first pass-through 22, and up the rear wall 98 of the refrigerator compartment 14 to a collection pan 224 that is disposed underneath the first evaporator 38. According to various aspects, the first drain tube 220 directs condensation that accumulates on the collection pan 224 to the drain pan that is disposed in the machine compartment 18.

Figure 7:
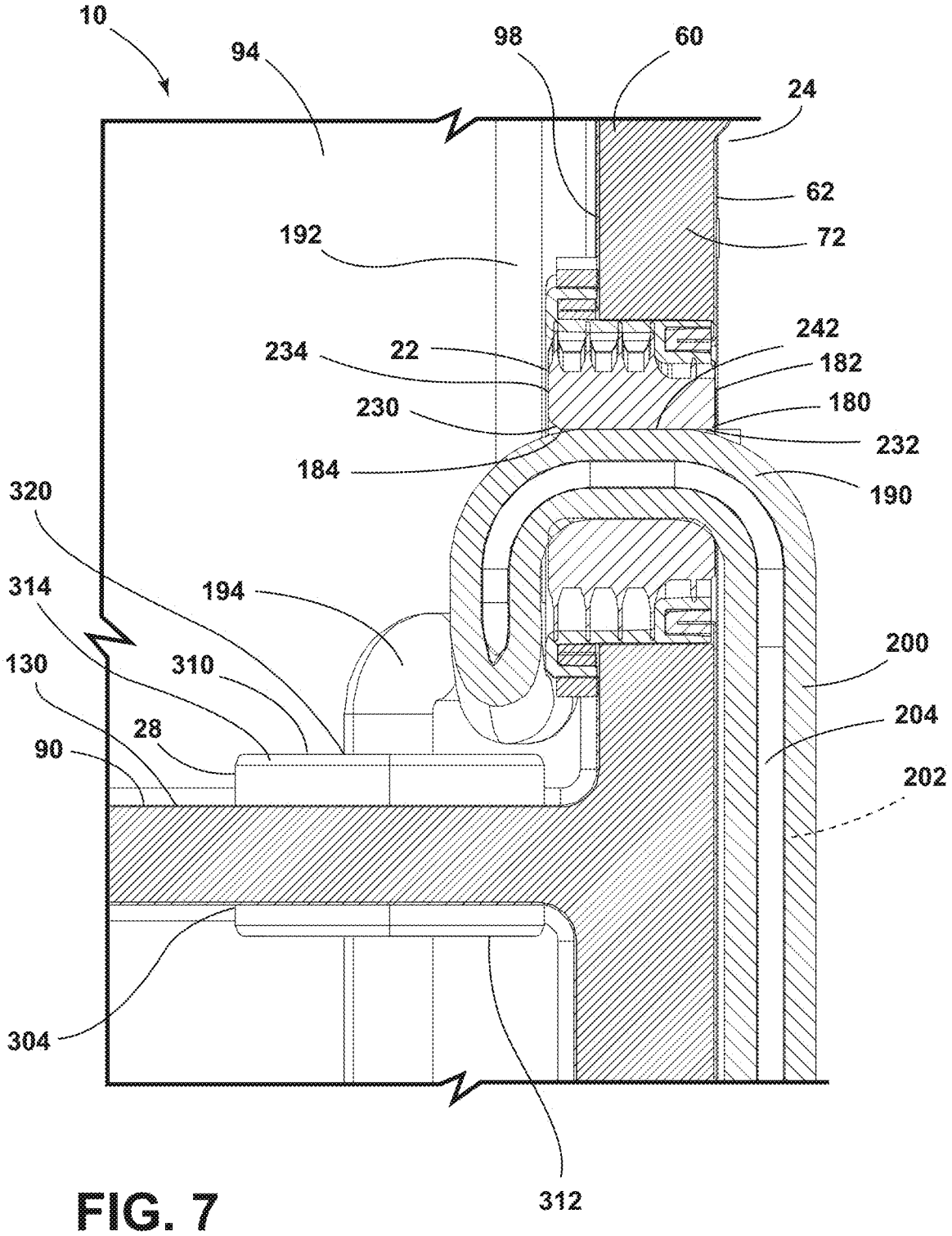
FIG. 7 is an enlarged, partial, cross-sectional view of a refrigeration appliance with a vacuum insulated cabinet defining a first pass-through and a third pass-through, according to the present disclosure.

Referring further to FIGS. 4, 5, and 7, the refrigeration appliance 10 includes a first pass-through grommet 230 disposed within the first pass-through 22. The first pass-through grommet 230 may have a shape that coincides with the shape of the first pass-through 22. For example, the first pass-through grommet 230 may have an oblong, circular, or one of other various shapes. The first pass-through grommet 230 may be disposed in the pass-through 22 such that a rear portion 232 of the first pass-through grommet 230 is recessed, flush, or protruding from the wrapper 62 and a front portion 234 of the first pass-through grommet 230 is recessed, flush, or protruding from the liner 64.

According to various aspects, the first pass-through grommet 230 substantially fills the first pass-through 22 to maintain an air-tight seal within the vacuum insulated cavity 60 about the first pass-through 22. The air-tight seal defined by the first pass-through grommet 230 is configured to reduce or prevent the flow of air from the external environment 24 and into the refrigerator compartment 14. In various aspects, the first pass-through grommet 230 may be configured to maintain the vacuum within the vacuum insulated cavity 60 while still permitting a connecting channel to extend through the vacuum insulated cavity 60, as provided herein.

In various aspects, the first pass-through grommet 230 may be oversized relative to the first pass-through 22 such that the air-tight seal may be at least partially maintained. It is also generally contemplated that the first pass-through grommet 230 may include components or structures that assist in at least partially maintaining the air-tight seal. For example, the first pass-through grommet 230 may include ribs or one or more sealing O-rings. It is further generally contemplated that the first pass-through grommet 230 can have a rubber or elastomeric composition and be slightly oversized relative to the first wrapper aperture 180 and the first liner aperture 184.

The first drain tube 220 and the first service line 190 extend through the first pass-through grommet 230. The first pass-through grommet 230 forms an air-tight seal around the first drain tube 220 and the first service line 190. For example, the first pass-through grommet 230 may define a first drain tube aperture 240, through which the first drain tube 220 extends, and a first service line aperture 242, through which the first service line 190 extends. The first drain tube aperture 240 and the first service line aperture 242 may be sized slightly smaller than the outer diameters of the first drain tube 220 and the first service line 190, respectively, to assist in maintaining the air-tight seal.

According to various aspects, the air-tight fitting of the first pass-through grommet 230 around the first drain tube 220 and the service line 190 helps limit heat transfer between the external environment 24 and the refrigerator compartment 14 through the first drain tube aperture 240 and the first service line aperture 242. Additionally, it is generally contemplated that the first pass-through grommet 230 may include an insulative material encircling the first drain tube aperture 240 and/or the first service line aperture 242 to assist in limiting heat transfer between the external environment 24 and the refrigerator compartment 14 through the first drain tube aperture 240 and the first service line aperture 242. It is further generally contemplated that the first pass-through grommet 230 may include one or more apertures that permit the extension of various other components through the first pass-through grommet 230. For example, the first pass-through grommet 230 may include an aperture 244 configured to permit the extension of an electrical harness, electrical wiring, and/or other physical or electrical connectors through the first pass-through grommet 230 to power various features, such the first evaporator fan 150 and various other features.

Referring to FIGS. 2, 3, and 6, the vacuum insulated structure 10 includes the second pass-through 26 that extends from the external environment 24 to the freezer compartment 16. The second pass-through 26 is defined by a second wrapper aperture 250, which may be defined on the rear panel 182 of the wrapper 62, and a second liner aperture 252 defined on the rear wall 118 of the freezer compartment 16 and generally aligns with the second wrapper aperture 250. According to various aspects, the second wrapper aperture 250 and the second liner aperture 252 may be defined such that the second pass-through 26 defines a circular shape, an oblong shape, or one of various other shapes. The second wrapper aperture 250 and the second liner aperture 252 are positioned on the wrapper 62 and the liner 64, respectively, such that passage is permitted between the external environment 24 and the freezer compartment 16. According to various aspects, the alignment of the second wrapper aperture 250 and the second liner aperture 252 is such that various components are permitted to extend through the second pass-through 26 from the external environment 24 and into the freezer compartment 16, as provided herein.

The refrigeration appliance 10 includes a second service line 260. The second service line 260 extends from the external environment 24, through the second pass-through 26, and into the freezer compartment 16. In some examples, the second service line 260 extends into the freezer compartment 16 and then along the rear wall 118 of the freezer compartment 16 and towards the ceiling 112 of the freezer compartment 16. Additionally, it is generally contemplated that one or more additional lines may extend through the second pass-through 26 and into the freezer compartment 16. For example, an additional suction line heat exchanger line may extend through the second pass-through 26 and into the freezer compartment 16.

Figure 8:
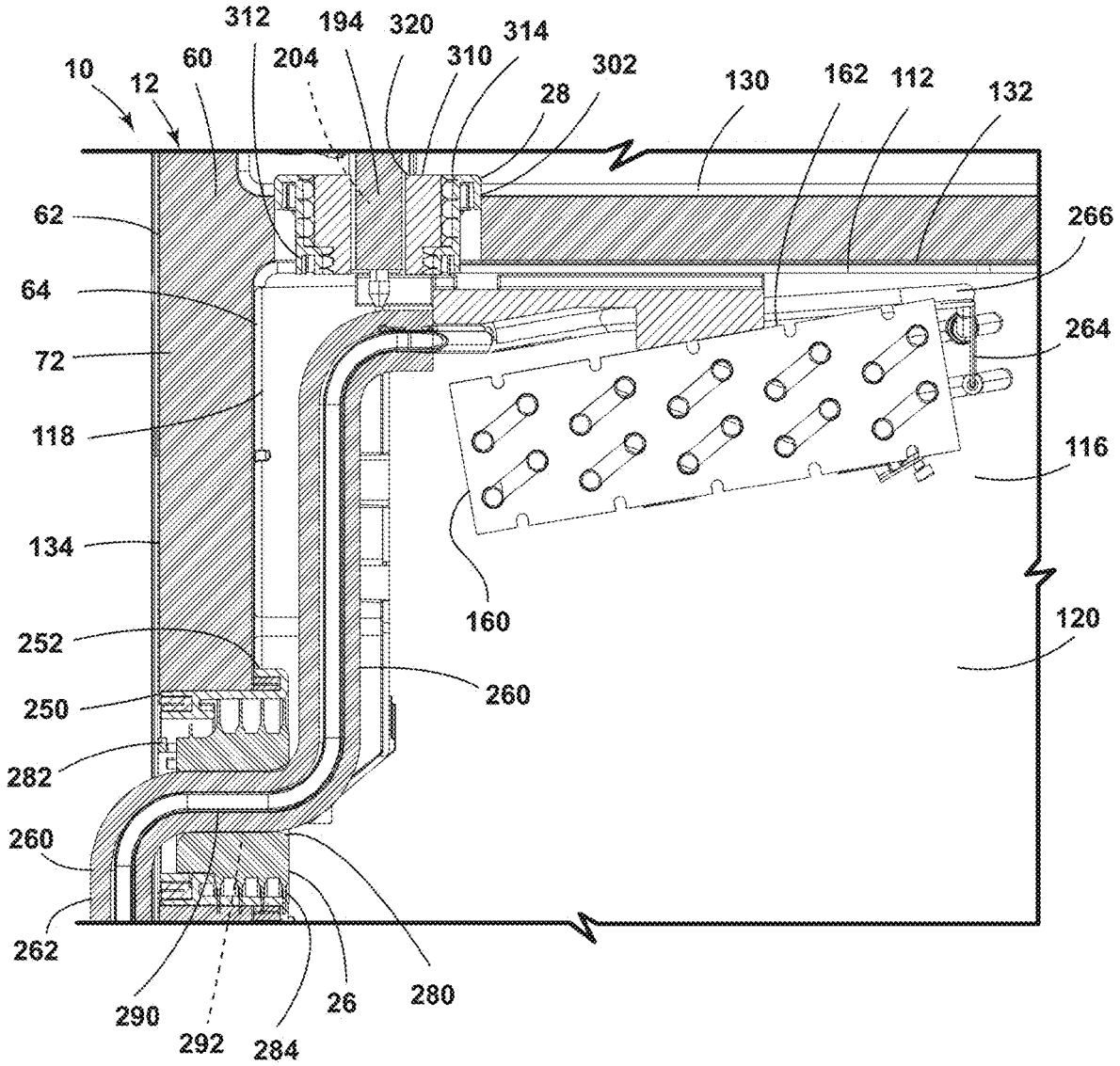
FIG. 8 is an enlarged, partial, cross-sectional view of a refrigeration appliance with a vacuum insulated cabinet, a second evaporator, and a second pass-through, according to the present disclosure.

Referring to FIGS. 2, 6, and 8, the second service line 260 may include an insulative sleeve 262 and one or more connectors and/or connection lines disposed within the insulative sleeve 262 for fluid and/or electrical connections within the appliance 10. In the illustrated example shown in FIG. 8, the second service line 260 includes a second capillary tube 264 and a second suction line 266 extending along and within the insulative sleeve 262. In such examples, the second capillary tube 264 and the second suction line 266 may both extend along the second service line 260 and out of an end of the second service line 260.

According to various aspects, the second capillary tube 264 and the second suction line 266 may be positioned within the second service line 260 such that the second capillary tube 264 and the second suction line 266 are either proximate or distal from each other. For example, the second capillary tube 264 and the second suction line 266 may be abutting as both the second capillary tube 264 and the second suction line 266 extend along the second service line 260. In such examples, the close proximity may permit transfer or thermal energy between the second capillary tube 264 and the second suction line 266.

According to various aspects, the second capillary tube 264 and the second suction line 266 are in fluid communication with the second evaporator 40. In use, the second capillary tube 264 carries the refrigerant to the second evaporator 40 and the suction line 266 carries the refrigerant away from the second evaporator 40. In some examples, the second capillary tube 264 may be coupled to an inlet of the second evaporator 40 and the suction line 266 may be coupled to an outlet of the second evaporator 40.

Referring to FIG. 6, a second drain tube 270, which is coupled to a collection pan, extends from the external environment 24, through the second pass-through 26, and into the freezer compartment 16. In some examples, the second drain tube 270 extends from the drain pan in the external environment 24, through the second pass-through 26, and up to the second evaporator 40. In use, the second drain tube 270 directs condensation that accumulates proximate to or on the second evaporator 40 to the drain pan that is disposed in the machine compartment 18.

Referring to FIGS. 2 and 6, the refrigeration appliance 10 includes a second pass-through grommet 280 disposed within the second pass-through 26. The second pass-through grommet 280 may have a shape that coincides with the shape of the second pass-through 26. For example, the second pass-through grommet 280 may have an oblong, circular, or one of other various shapes. The second pass-through grommet 280 may be disposed in the second pass-through 26 such that a rear section 282 of the second pass-through grommet 280 is recessed, flush, or protruding from the wrapper 62 and a front section 284 of the second pass-through grommet 280 is recessed, flush, or protruding from the liner 64 at the rear wall 118 of the freezer compartment 16.

According to various aspects, the second pass-through grommet 280 can help maintain an air-tight seal within the vacuum insulated structure about the second pass-through 26. The air-tight seal defined by the second pass-through grommet 280 is configured to reduce or prevent the flow of air from the external environment 24 and into the freezer compartment 16. In various aspects, the second pass-through grommet 280 may be configured to maintain the vacuum within the vacuum insulated cavity 60 while still permitting a connecting channel to extend through the vacuum insulated cavity 60, as provided herein.

In various aspects, the second pass-through grommet 280 may be oversized relative to the second pass-through 26 such that the air-tight seal may be at least partially maintained. It is also generally contemplated that the second pass-through grommet 280 may include components or structure that assists in at least partially maintaining the air-tight seal. For example, the second pass-through grommet 280 may include ribs or one or more sealing O-rings. It is further generally contemplated that the second pass-through grommet 280 can have a rubber or elastomeric composition and be slightly oversized relative to the second wrapper aperture 250 and the second liner aperture 252.

The second drain tube 270 and the second service line 260 extend through the second pass-through grommet 280. The second pass-through grommet 280 forms an air-tight seal around the second drain tube 270 and the second service line 260. For example, the second pass-through grommet 280 may define a second drain tube aperture 292, through which the second drain tube 270 extends, and a second service line aperture 290, through which the second service line 260 extends. The second drain tube aperture 292 and the second service line aperture 290 may be sized slightly smaller than the outer diameters of the second drain tube 270 and the second service line 260, respectively, to maintain an air-tight seal.

According to various aspects, the air-tight fitting of the second pass-through grommet 280 around the second drain tube 270 and the second service line 260 helps limit heat transfer between the external environment 24 and the freezer compartment 16 through the second drain tube aperture 292 and the second service line aperture 290. Additionally, it is generally contemplated that the second pass-through grommet 280 may include an insulative material encircling the second drain tube aperture 292 and/or the second service line aperture 290 to assist in limiting heat transfer between the external environment 24 and the freezer compartment 16 through the second drain tube aperture 292 and the second service line aperture 290. It is further generally contemplated that the second pass-through grommet 280 may include one or more apertures that permit the extension of various other components through the second pass-through grommet 280. For example, the second pass-through grommet 280 may include an aperture 294 configured to permit the extension of an electrical harness, electrical wiring, and/or other physical or electrical connectors through the second pass-through grommet 280 to power various features, such the second evaporator fan 170 and various other features.

Referring further to FIGS. 3, 5, 7, and 8, the mullion region 20 defines a third pass-through 28. The third pass-through 28 may be defined by a top aperture 302 defined by the top section 130 of the mullion region 20 (e.g., the floor 90 of the refrigerator compartment 14) and a bottom aperture 304 defined by the bottom section 132 of the mullion region 20 (e.g., the ceiling 112 of the freezer compartment 16) and generally aligns with the top aperture 302. According to various aspects, the top aperture 302 and the bottom aperture 304 may be defined such that the third pass-through 28 defines a circular shape, an oblong shape, or one of various other shapes. In some examples, the top aperture 302 and the bottom aperture 304 are positioned on the mullion region 20 such that passage is permitted between the refrigerator compartment 14 and the freezer compartment 16. According to various aspects, the alignment of the top aperture 302 and the bottom aperture 304 is such that various components are permitted to extend through the third pass-through 28 and between the refrigerator compartment 14 and the freezer compartment 16, as provided herein.

According to various aspects, the second branch 194 of the first service line 190 may extend from the refrigerator compartment 14, through the third pass-through 28, and into the freezer compartment 16. In such aspects, the second branch 194 of the first service line 190 encompasses the first suction line 204, which extends from the outlet 212 of the first evaporator 38, through the third pass-through 28, and to the second evaporator 40.

Referring to FIGS. 3 and 5, the refrigeration appliance 10 includes a third pass-through grommet 310 disposed within the third pass-through 28. The third pass-through grommet 310 may have a shape that coincides with the shape of the third pass-through 28. For example, the third pass-through grommet 310 may have an oblong, circular, or one of other various shapes. The third pass-through grommet 310 may be disposed in the third pass-through 28 such that a bottom section 312 of the third pass-through grommet 310 is recessed, flush, or protruding from the ceiling 112 of the freezer compartment 16 (e.g., the mullion region bottom section 132) and is adjacent the rear wall 118 of the freezer compartment 16, and a top section 314 of the third pass-through grommet 310 is recessed, flush, or protruding from the floor 90 of the refrigerator compartment 14 (e.g., the mullion region top section 130) and is adjacent the rear wall 98 of the refrigerator compartment 14.

According to various aspects, the third pass-through grommet 310 can help maintain an air-tight seal within the vacuum insulated structure about the third pass-through 28. The air-tight seal defined by the third pass-through grommet 310 is configured to reduce or prevent the flow of air between the refrigerator compartment 14 and the freezer compartment 16. In various aspects, the first pass-through grommet 230 may be configured to maintain the vacuum within the vacuum insulated cavity 60 while still permitting a connecting channel to extend through the vacuum insulated cavity 60, as provided herein.

In various aspects, the third pass-through grommet 310 may be oversize relative to the third pass-through 28 such that the air-tight seal may be at least partially maintained. It is also generally contemplated that the third pass-through grommet 310 may include components or structure that assists in at least partially maintaining the air-tight seal. For example, the third pass-through grommet 310 may include ribs or one or more sealing O-rings. It is further generally contemplated that the third pass-through grommet 310 can have a rubber or elastomeric composition and be slightly oversized relative to the top aperture 302 and the bottom aperture 304.

The second branch 194 of the first service line 190 extends through the third pass-through grommet 310. The third pass-through grommet 310 forms an air-tight seal around the second branch 194 of the first service line 190. For example, the third pass-through grommet 310 may define a second branch aperture 320 through which the second branch 194 extends. The second branch aperture 320 may be sized slightly smaller than the outer diameter of the second branch 194 of the first service line 190 to maintain an air-tight seal.

According to various aspects, the air-tight fitting of the third pass-through grommet 310 around the second branch 194 of the first service line 190 helps limit heat transfer between the external environment 24 and the freezer compartment 16 through the second branch aperture 320. Additionally, it is generally contemplated that the third pass-through grommet 310 may include an insulative material encircling the second branch aperture 194 to assist in limiting heat transfer between the refrigerator compartment 14 and the freezer compartment 16 through the second branch aperture 320.

Referring again to FIG. 2, the appliance 10 includes the machine compartment 18 which contains components of the refrigerant system 30. The machine compartment 18 is shown below a bottom portion of the rear panel 330, with an inner surface 332 at least partially defined by the cabinet 12. According to various aspects, the external environment 24 can include the machine compartment 18. For example, the machine compartment 18 can be on an opposing side of the cabinet 12 relative to the refrigerator compartment 14 and the freezer compartment 16. In such examples, the machine compartment 18 is separated from both compartments 14, 16 via the vacuum insulated cavity 60 defined between the wrapper 62 and the liner 64. According to various aspects, the machine compartment 18 operably houses various components or portions of components of the refrigerant system 30 and the appliance 10, such as a compressor 340, a condenser 342 in fluid communication with the compressor 340, a control box 344, the drain pan, refrigerant lines 346, which fluidly couple the compressor 340 to the condenser 342, and various other components, as provided herein.

The three-way valve 32 may be disposed in various locations throughout the appliance 10. For example, the three-way valve 32 may be disposed in the machine compartment 18 proximate the compressor 340 and/or the condenser 342. The three-way valve 32 is fluidly coupled to the first evaporator 38 via the first capillary tube 202, which extends from the three-way valve 32 to the first evaporator 38. The three-way valve 32 is also fluidly coupled to the second evaporator 40 via the second capillary tube 264, which extends from the three-way valve 32 to the second evaporator 40. It is also generally contemplated that the three-way valve 32 may be at least partially coupled to either the first evaporator 38 and/or the second evaporator 40 via one or more expansion valves.

The three-way valve 32 may also be fluidly coupled to and downstream from the condenser 342 or a drier 360. As the refrigerant flows through the three-way valve 32, the three-way valve 32 splits the flow of the refrigerant between the first flow path 34 and the second flow path 36, as provided herein. The three-way valve 32 may direct the flow of the refrigerant via one or more actuators. For example, the three-way valve 32 may include an electronic actuator in communication with a controller, where the controller outputs a signal or signals to the electronic actuator to direct the flow of the refrigerant.

According to various aspects, the controller may include a processor configured to execute various routines stored in a memory of the controller. The routines may relate to the function of the refrigerant system 30, such as the three-way valve 32. The controller may output a signal to actuate the three-way valve 32 to direct refrigerant along the first flow path 34 or the second flow path 36 depending on various conditions. For example, the controller may determine the refrigerator compartment 14 is within a temperature range of about 0° C. to about 8° C. and that the freezer compartment 16 is above a temperature of about 0° C. In such examples, the controller may actuate the three-way valve 32 to direct the coolant along the second flow path 36, bypassing the first evaporator 38, so the second evaporator 40 may efficiently cool the freezer compartment 16. Additionally, or alternatively, it is generally contemplated that the controller may direct refrigerant flow based on various other conditions, such as a base operating condition where refrigerant is directed along the first flow path 34, or other various conditions.

As illustrated in FIG. 9, a flow diagram depicts a refrigerant loop 350 for a thermal exchange media, referred to herein as the refrigerant, through the refrigerant system 30. The refrigerant is generally capable of undergoing repeated phase changes between a liquid and a gas. The refrigerant system 30 generally performs a refrigeration cycle that cools the refrigerator compartment 14 and the freezer compartment 16 by using the refrigerant as the thermal exchange media between the compartments 14, 16 and the external environment 24. The refrigerant generally flows along the refrigerant loop 350 from the compressor 340, through the condenser 342, then the drier 360, and then to the three-way valve 32, where the refrigerant is either directed along the first flow path 34 or the second flow path 36 via an actuator, and then back to the compressor 340.

The refrigerant enters the compressor 340 as a low-pressure gas. The compressor 340 is configured to compress the refrigerant into a higher-pressure gas. During the compression, the refrigerant temperature increases. The compressor 340 is also configured to drive or circulate the refrigerant through the refrigerant system 30. The refrigerant exits the compressor 340 as the higher-pressure gas and enters the refrigerant line 346 which leads to the condenser 342.

The refrigerant, which is in the higher-pressure gas state, then enters the condenser 342. The condenser 342 is configured as a heat exchanger that may exchange heat with ambient air in the external environment 24. The condenser 342 condenses the refrigerant to a liquid, releasing heat. The drier 360, which is in fluid communication with the condenser 342 and may be coupled to the condenser 342, traps moisture, dirt, or other contaminants that may be present in the refrigerant system 30. The refrigerant exits the drier 360 and is directed to the three-way valve 32, where the refrigerant is either directed along the first flow path 34 or the second flow path 36.

In the first flow path 34, the refrigerant is directed from the three-way valve 32 and through the first capillary tube 202, which extends through the first pass-through 22, into the refrigerator compartment 14, and to the inlet 210 of the first evaporator 38. As the refrigerant travels through the first capillary tube 202, the pressure of the refrigerant drops to a lower pressure. According to various aspects, the pressure drop of the refrigerant in the first capillary tube 202 is at least partially determined by the internal diameter of the first capillary tube 202.

As the refrigerant enters the first evaporator 38 from the first capillary tube 202, the refrigerant experiences a pressure drop and becomes a low-pressure liquid configured to absorb heat. In use, the low-pressure liquid absorbs heat from the refrigerator compartment 14, thereby cooling the refrigerator compartment 14. Additionally, the absorption of heat from the air within the refrigerator compartment 14 by the refrigerant may be aided by the airflow generated by the first evaporator fan 150.

Referring further to FIG. 9, the refrigerant flows from the first evaporator 38 via the first suction line 204. The first suction line 204 extends from the outlet 212 of the first evaporator 38, through the third pass-through 28 that extends through the mullion region 20, and couples to the second evaporator 40. The refrigerant, once in the second evaporator 40, is in the low-pressure liquid state and is configured to absorb heat. In use, the low-pressure liquid absorbs heat from the freezer compartment 16, thereby cooling the freezer compartment 16. Additionally, the absorption of heat from the air within the freezer compartment 16 by the refrigerant may be aided by the airflow generated by the second evaporator fan 170. The refrigerant, in the first flow path 34, then leaves the second evaporator 40 and is directed back to the compressor 340, where the refrigerant enters the compressor 340 as a low pressure gas.

Referring further to FIG. 9, the second flow path 36 is directed from the three-way valve 32 and through the second capillary tube 264, which bypasses the first evaporator 38 and extends through the second pass-through 26, into the freezer compartment 16, and to the inlet of the second evaporator 40. As the refrigerant travels through the second capillary tube 264, the pressure of the refrigerant drops to a lower pressure. According to various aspects, the pressure drop of the refrigerant in the second capillary tube 264 is at least partially determined by the internal diameter of the second capillary tube 264.

As the refrigerant enters the second evaporator 40 from the second capillary tube 264, the refrigerant experiences a pressure drop and becomes a low-pressure liquid configured to absorb heat. In use, the low-pressure liquid absorbs heat from the freezer compartment 16. The absorption of heat from the air within the freezer compartment 16 by the refrigerant may be aided by the airflow generated by the second evaporator fan 170. The refrigerant, after flowing through the second evaporator 40, flows back towards the compressor 340.

Referring to FIGS. 1-9, the appliance 10 having the refrigerant system 30 with the first evaporator 38 and the second evaporator 40 arranged in series along the first flow path 34 and the second evaporator 40 being disposed along the second flow path 36 provides for an appliance 10 that may efficiently and selectively cool both compartments 14, 16 or the freezer compartment 16. In particular, the placement of the first evaporator 38 in the refrigerator compartment 14 and the second evaporator 40 in the freezer compartment 16 provides for an appliance 10 that may cool both compartments 14, 16 via the first flow path 34 and/or cool the freezer compartment 16 via the second flow path 36, bypassing the refrigerator compartment 14. The appliance 10, by being able to cool either both compartments 14, 16 via the first flow path 34, or the freezer compartment 16 via the second flow path 36, can either efficiently maintain an operating temperature of both compartments via the first flow path 34, or rapidly and efficiently cool the freezer compartment 16 via the second flow path 36. Additionally, the flow of the refrigerant through the first pass-through 22 and the third pass-through 28 in the first flow path 34 and the flow of the refrigerant through the second pass-through 26 in the second flow path 36 is such that the vacuum within the vacuum insulated cabinet 12 of the appliance 10 is maintained.

According to various examples, the refrigerant system 30, with the first flow path 34 that extends through the first pass-through 22 and the third pass-through 28, and the second flow path 36 that extend through the second pass-through 26, can be used in various appliances. These appliances can include, but are not limited to, refrigerators, freezers, coolers, dishwashers, and other similar appliances and fixtures within household and commercial settings.

Referring further to FIGS. 1-9, the present disclosure provides for a variety of advantages. For example, the placement of the first evaporator 38 within the refrigerator compartment 14 and the placement of the second evaporator 40 within the freezer compartment 16 provides for efficient cooling of the refrigerator compartment 14 and the freezer compartment 16. Similarly, the placement of the first evaporator 38 and the second evaporator 40 in series provides for improved system balance between the first evaporator 38 and the second evaporator 40. Further, the series arrangement of both evaporators 38, 40 increases a cooling load to reduce or prevent liquid refrigerant from entering the compressor 340, which reduces external condensation on the refrigerant lines 346.

Additionally, the extension of the first service line 190 and the first drain tube 220 through the first pass-through 22, and the extension of the second service line 260 and the second drain tube 270 through the second pass-through 26 reduces or limits the number of apertures through the vacuum insulated cabinet 12 to fluidly couple the first evaporator 38 and the second evaporator 40 with the other components of the refrigerant system 30. Similarly, the first pass-through 22 and the second pass-through 26 increase the ability of the vacuum insulated cabinet 12 to maintain a vacuum. Further, the extension of the first suction line 204 through the third pass-through 28 provides for the extension of the first suction line 204 through the mullion region 20, while reducing or limiting the number of apertures in the mullion region 20 and assisting in maintaining the temperature of the refrigerator compartment 14 and the freezer compartment 16. Additional benefits or advantages of using this appliance 10 may also be realized and/or achieved.

The device disclosed herein is further summarized in the following paragraphs and is further characterized by combinations of any and all of the various aspects described herein.

According to an aspect of the present disclosure, a refrigeration unit is provided that includes a cabinet that defines a refrigerator compartment, a freezer compartment, and a machine compartment. The cabinet includes a mullion region between the refrigerator compartment and the freezer compartment, a first pass-through therethrough providing access from an external environment to the refrigerator compartment, and a second pass-through therethrough providing access from the external environment to the freezer compartment. The cabinet further includes a third pass-through extending through the mullion region, and a refrigerant system. The refrigerant system includes a three-way valve configured to direct a refrigerant down a first flow path or a second flow path. The refrigerant in the first flow path flows through the first pass-through, a first evaporator, the third pass-through, and the second evaporator, and the refrigerant in the second flow path flows through the second pass-through and the second evaporator.

According to another aspect, a first evaporator and a second evaporator are arranged in series along a first flow path.

According to another aspect, a first evaporator is disposed in a refrigerator compartment and a second evaporator is disposed in a freezer compartment.

According to another aspect, a first evaporator fan is proximate a first evaporator and a second fan is proximate a second evaporator.

According to another aspect, a refrigerant system includes a compressor fluidly coupled to a first evaporator and a second evaporator, a condenser downstream of the compressor and in fluid communication with the compressor, and a drier downstream of the condenser and in fluid communication with the condenser.

According to another aspect, a first capillary tube upstream of a first evaporator and a second capillary tube upstream of a second evaporator. The refrigerant in a first flow path flows through the first capillary tube, and the refrigerant in a second flow path flows through the second capillary tube.

According to another aspect, a first pass-through grommet is disposed in a first pass-through, a second pass-through grommet is disposed in a second pass-through, and a third pass-through grommet is disposed in a third pass-through.

According to another aspect, the first pass-through grommet defines at least one aperture through which the first capillary tube extends, and the second pass-through grommet defines at least one aperture through which the second capillary tube extends.

According to another aspect, a first evaporator is a first roll bond evaporator coupled to a rear wall of a refrigerator compartment.

According to another aspect of the present disclosure, a refrigeration unit is provided that includes a cabinet defining a refrigerator compartment, a freezer compartment, and a machine compartment. The cabinet also includes a wrapper, a liner encompassed by the wrapper, a mullion region between the refrigerator compartment and the freezer compartment, a first pass-through therethrough providing access from an external environment to the refrigerator compartment, a second pass-through therethrough providing access from the external environment to the freezer compartment, a third pass-through extending through the mullion region, and a refrigerant system. The refrigerant system includes a first refrigerant flow path, where a refrigerant is directed through the first pass-through, a first evaporator, the third pass-through, and a second evaporator in the first refrigerant flow path. The refrigerant system also includes a second refrigerant flow path, where the refrigerant is directed through the second pass-through and the second evaporator in the second refrigerant flow path.

According to another aspect, a first service line extends through a first pass-through. The first service line encompasses a first capillary tube that extends from an external environment to a first evaporator.

According to another aspect, a first service line includes a first branch that extends towards a ceiling of a refrigerator compartment and a second branch that extends through a third pass-through and into a freezer compartment. The second branch at least partially encompasses a first suction line that extends from the first evaporator, through the third pass-through, and into a second evaporator.

According to another aspect, a first branch at least partially encompasses a first capillary tube and a first suction line.

According to another aspect, refrigerant is directed through a first capillary tube along a first refrigerant flow path, and the refrigerant is directed through a second capillary tube along a second refrigerant flow path, and the first capillary tube extends through a first pass-through and the second capillary tube extends through a second pass-through.

According to another aspect, a first fan proximate a first evaporator and a second fan proximate a second evaporator is provided.

According to another aspect, a first pass-through and a second pass-through are defined on a rear portion of a cabinet.

According to yet another aspect of the present disclosure, a vacuum insulated refrigeration appliance is provided. The vacuum insulated refrigeration appliance includes a cabinet that defines a refrigerator compartment, a freezer compartment, and a mullion region between the refrigerator compartment and the freezer compartment. A first pass-through is defined through the mullion region, and a second pass-through extends through the cabinet and provides access from an external environment to the refrigerator compartment. The appliance also includes a first service line extending through the second pass-through and into the refrigerator compartment. The first service line includes at least one branch extending through the first pass-through and into the freezer compartment. The refrigerant system includes a first evaporator, a second evaporator, and a three-way valve that selectively directs a refrigerant along at least one of a first flow path through the first evaporator, the first pass-through, and the second evaporator, and a second flow path through the second evaporator. The first evaporator and the second evaporator are arranged in series along the first flow path. The refrigerant at least partially flows along the at least one branch along the first flow path.

According to yet another aspect, a third pass-through extends through a cabinet. The third pass-through provides access from an external environment to a freezer compartment. A first pass-through extends through a mullion region and provides access from a refrigerator compartment to the freezer compartment.

According to yet another aspect, a vacuum insulated refrigeration unit includes a first capillary tube upstream of a first evaporator and extending through a second pass-through and a second capillary tube upstream of a second evaporator and extending through a third pass-through. A refrigerant in a first flow path flows through the first capillary tube, and the refrigerant in a second flow path flows through the second capillary tube.

According to another aspect, a first pass-through grommet is disposed in a first pass-through that extends through a mullion region. A first pass-through grommet defines at least one aperture configured to permit extension of a first capillary tube through the first pass-through grommet. A second pass-through grommet is disposed in a second pass-through, and the second pass-through grommet defines at least one aperture configured to permit extension of a first capillary tube through the second pass-through grommet. A third pass-through grommet is disposed in a third pass-through. The third pass-through grommet defines at least one aperture through which a second capillary tube extends.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration appliance, comprising:

a cabinet defining a refrigerator compartment, a freezer compartment, and a machine compartment, wherein the cabinet includes:

a vacuum insulated mullion region between the refrigerator compartment and the freezer compartment;

a first pass-through defined through the cabinet and providing access from an external environment to the refrigerator compartment;

a second pass-through defined through the cabinet providing access from the external environment to the freezer compartment; and a third pass-through extending through the vacuum insulated mullion region and connecting the refrigerator compartment and the freezer compartment; and a refrigerant system including a three-way valve configured to selectively direct a refrigerant along a first flow path through the first pass-through, a first evaporator, the third pass-through, and a second evaporator and along a second flow path through the second pass-through and the second evaporator.

2. The refrigeration appliance of claim 1, wherein the first evaporator and the second evaporator are arranged in series along the first flow path.

3. The refrigeration appliance of claim 1, wherein the first evaporator is disposed in the refrigerator compartment and the second evaporator is disposed in the freezer compartment.

4. The refrigeration appliance of claim 1, further comprising:

a first evaporator fan proximate the first evaporator; and a second fan proximate the second evaporator.

5. The refrigeration appliance of claim 1, wherein the refrigerant system includes:

a compressor fluidly coupled to the first evaporator and the second evaporator;

a condenser downstream of the compressor and in fluid communication with the compressor; and a drier downstream of the condenser and in fluid communication with the condenser.

6. The refrigeration appliance of claim 5, wherein the refrigerant system includes:

a first capillary tube upstream of the first evaporator; and a second capillary tube upstream of the second evaporator, wherein the refrigerant in the first flow path flows through the first capillary tube, and wherein the refrigerant in the second flow path flows through the second capillary tube.

7. The refrigeration appliance of claim 6, further comprising:

a first pass-through grommet disposed in the first pass-through;

a second pass-through grommet disposed in the second pass-through; and a third pass-through grommet disposed in the third pass-through.

8. The refrigeration appliance of claim 7, wherein the first pass-through grommet defines at least one aperture through which the first capillary tube extends, and wherein the second pass-through grommet defines at least one aperture through which the second capillary tube extends.

9. The refrigeration appliance of claim 1, wherein the first evaporator is a first roll bond evaporator coupled to a rear wall of the refrigerator compartment.

10. A refrigeration appliance, comprising:

a cabinet defining a refrigerator compartment, a freezer compartment, and a machine compartment, wherein the cabinet includes:

a wrapper;

a liner coupled to the wrapper; and defining a vacuum insulated cavity therebetween, wherein the vacuum insulated cavity forms a vacuum insulated mullion region between the refrigerator compartment and the freezer compartment;

a first pass-through defined through the wrapper and the liner to provide access from an external environment to the refrigerator compartment;

a second pass-through defined through the wrapper and the liner to provide access from the external environment to the freezer compartment; and a third pass-through extending through the vacuum insulated mullion region and connecting the refrigerator compartment and the freezer compartment; and a refrigerant system including a first evaporator and a second evaporator, wherein a refrigerant is selectively directed along a first refrigerant flow path through the first pass-through, the first evaporator, the third pass-through through the vacuum insulated mullion region, and the second evaporator and along a second refrigerant flow path through the second pass-through and the second evaporator.

11. The refrigeration appliance of claim 10, further comprising:

a first service line extending through the first pass-through, the first service line encompassing a first capillary tube that extends from the external environment to the first evaporator.

12. The refrigeration appliance of claim 11, wherein the first service line includes a first branch that extends towards a ceiling of the refrigerator compartment and a second branch that extends through the third pass-through and into the freezer compartment, and wherein the second branch at least partially encompasses a first suction line that extends from the first evaporator, through the third pass-through, and to the second evaporator.

13. The refrigeration appliance of claim 12, wherein the first branch at least partially encompasses the first capillary tube and the first suction line.

14. The refrigeration appliance of claim 10, wherein the refrigerant is directed through a first capillary tube along the first refrigerant flow path, and wherein the refrigerant is directed through a second capillary tube along the second refrigerant flow path, and further wherein the first capillary tube extends through the first pass-through and the second capillary tube extends through the second pass-through.

15. The refrigeration appliance of claim 10, further comprising:

a first fan proximate the first evaporator; and a second fan proximate the second evaporator.

16. The refrigeration appliance of claim 10, wherein the first pass-through and the second pass-through are defined by a rear portion of the cabinet.

17. A vacuum insulated refrigeration appliance, comprising:

a cabinet defining:

a refrigerator compartment having a floor;

a freezer compartment having a ceiling;

a vacuum insulated mullion region defined by and between the floor of the refrigerator compartment and the ceiling of the freezer compartment, wherein a first pass-through is defined through the floor, the vacuum insulated mullion region, and the ceiling to connect the refrigerator compartment and the freezer compartment; and a second pass-through extending through the cabinet, the second pass-through providing access from an external environment to the refrigerator compartment;

a first service line extending through the second pass-through and into the refrigerator compartment, the first service line including at least one branch extending through the first pass-through of the vacuum insulated mullion region and into the freezer compartment; and a refrigerant system including a first evaporator, a second evaporator, and a three-way valve that selectively directs a refrigerant along at least one of a first flow path through the first evaporator, the first pass-through, and the second evaporator, and a second flow path through the second evaporator, wherein the first evaporator and the second evaporator are arranged in series along the first flow path, and wherein the refrigerant at least partially flows along the at least one branch along the first flow path.

18. The vacuum insulated refrigeration appliance of claim 17, further comprising:

a third pass-through extending through the cabinet, the third pass-through providing access from the external environment to the freezer compartment, wherein the first pass-through extending through the vacuum insulated mullion region provides access from the refrigerator compartment to the freezer compartment.

19. The vacuum insulated refrigeration appliance of claim 18, further comprising:

a first capillary tube upstream of the first evaporator and extending through the second pass-through; and a second capillary tube upstream of the second evaporator and extending through the third pass-through, wherein the refrigerant in the first flow path flows through the first capillary tube, and wherein the refrigerant in the second flow path flows through the second capillary tube.

20. The vacuum insulated refrigeration appliance of claim 19, further comprising:

a first pass-through grommet disposed in the first pass-through extending through the vacuum insulated mullion region;

a second pass-through grommet disposed in the second pass-through, wherein the second pass-through grommet defines at least one aperture through which the first capillary tube extends; and a third pass-through grommet disposed in the third pass-through, wherein the third pass-through grommet defines at least one aperture through which the second capillary tube extends.

* * * * *